United States Patent [19]

Caretto

[11] Patent Number: 4,573,302

[45] Date of Patent: Mar. 4, 1986

[54] METHOD OF CONSTRUCTING HOUSES

[76] Inventor: Robert J. Caretto, 1906 E. Vinedo, Tempe, Ariz. 85284

[21] Appl. No.: 710,311

[22] Filed: Mar. 11, 1985

[51] Int. Cl.[4] ..... E04B 1/00

[52] U.S. Cl. ..... 52/742; 52/745; 52/105; 52/169.1; 33/563

[58] Field of Search ..... 52/105, 169.1, 169.2, 52/742, 745; 33/562, 563

[56] References Cited

U.S. PATENT DOCUMENTS

| | | | |
|---|---|---|---|
| 2,528,211 | 10/1950 | Civkin | 52/105 X |
| 2,721,369 | 10/1955 | Burke | 25/155 |
| 2,722,040 | 11/1955 | Ludowici | 52/745 X |
| 2,908,048 | 6/1956 | Johnson | 20/2 |
| 2,961,940 | 11/1960 | Kump | 98/33 |
| 2,978,840 | 4/1961 | Tatsch | 50/100 |
| 3,376,010 | 4/1968 | Myer | 249/13 |
| 3,397,494 | 8/1968 | Waring | 52/122 |
| 3,468,094 | 9/1969 | Campbell | 52/742 |
| 3,600,870 | 8/1971 | Greenhalgh | 52/745 |
| 3,816,931 | 6/1974 | LaMar | 33/563 |
| 4,110,952 | 9/1978 | Blachura | 52/745 |
| 4,187,659 | 2/1980 | Blachura | 52/745 |
| 4,219,978 | 9/1980 | Brown | 52/125 |
| 4,231,199 | 11/1980 | Gomez et al. . | |
| 4,443,992 | 4/1984 | Shechter | 52/745 |

*Primary Examiner*—Henry E. Raduazo
*Assistant Examiner*—John Malcolm White
*Attorney, Agent, or Firm*—LaValle D. Ptak

[57] ABSTRACT

A method is disclosed of constructing a housing development in which the necessity for taking repetitious measurements and re-measurements throughout the various stages of construction is minimized. A construction surface in the form of the floor of a school or building in a shopping center associated with the housing development initially is established. Full scale dimensionally-stable, flexible templates are used at each building site location to mark the foundation footings and plumbing trenches required for the houses to be built. A first metal frame and all of the below-floor plumbing is assembled together as a unit. The first frame then is moved to the lot location after trenching has been completed, and is lowered in place prior to the pouring of the concrete foundation and the floor of the house. A second template is used to mark the location of various construction items for the house on the construction surface. Construction of the remainder of the house then is accomplished on a second metal frame placed on the construction surface. After completion, the house is moved to the building location and the second metal frame is welded to the first metal frame to complete the house construction.

24 Claims, 10 Drawing Figures

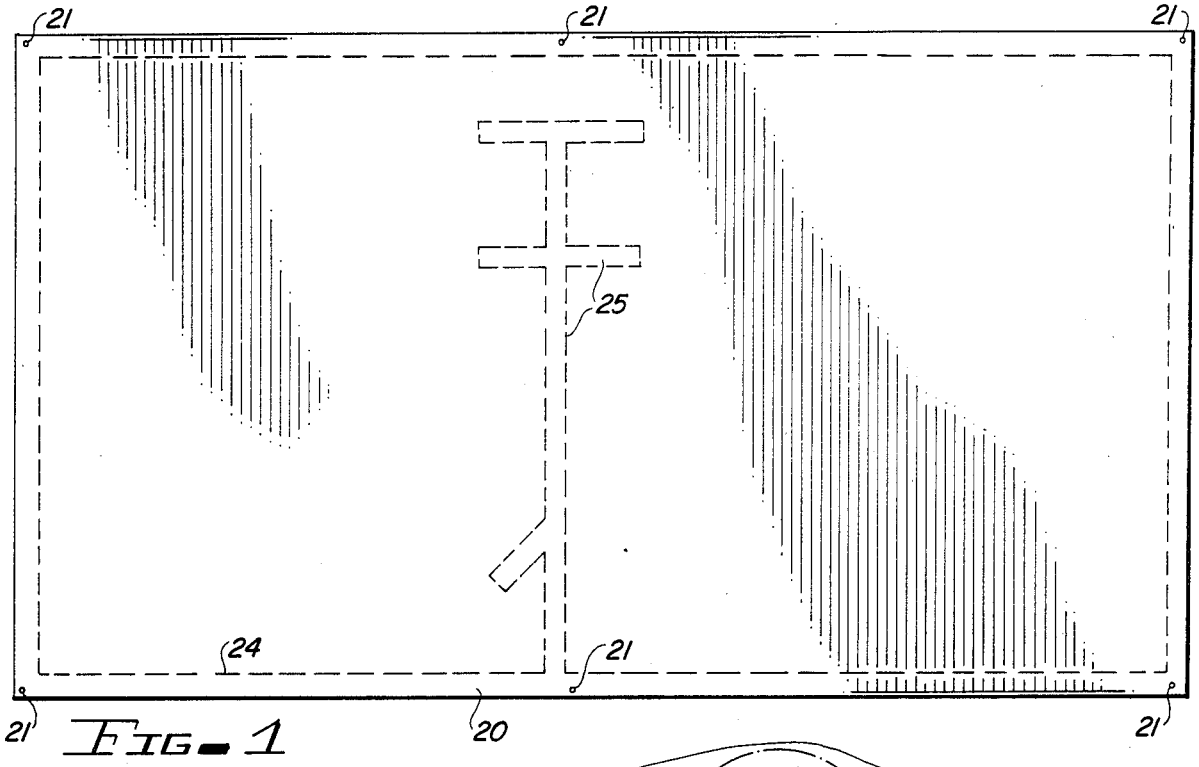
FIG. 1
FIG. 2
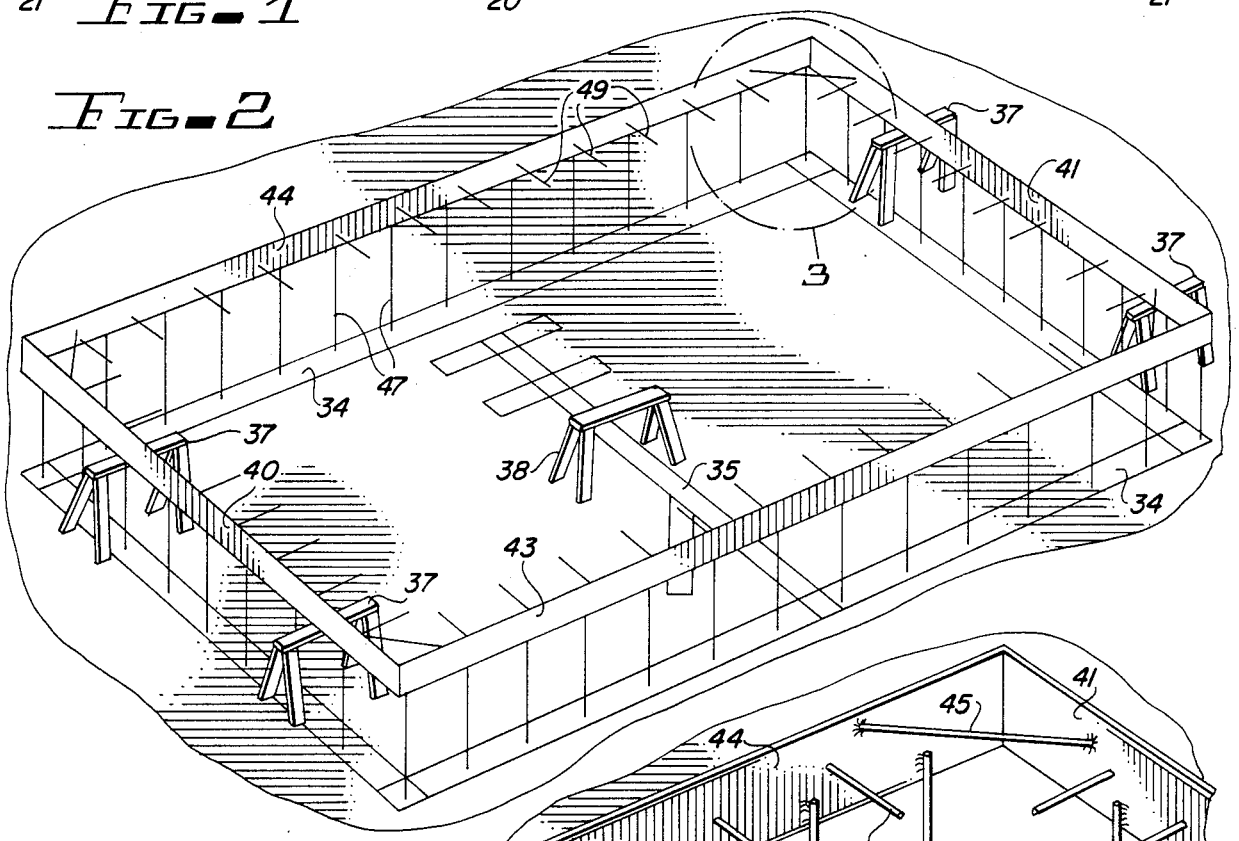
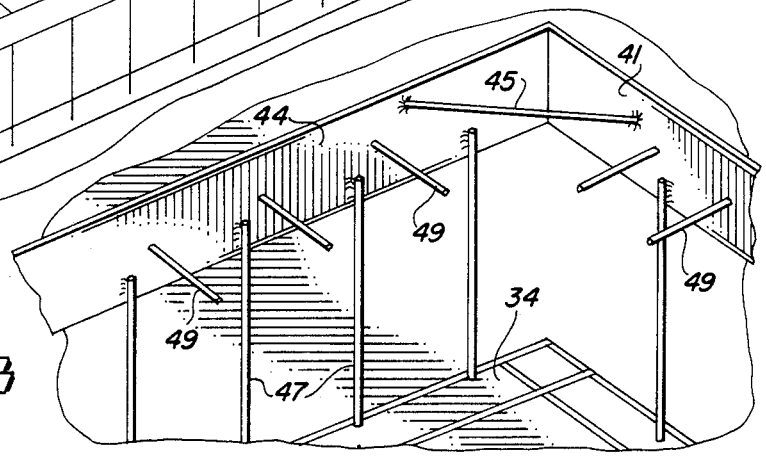
FIG. 3

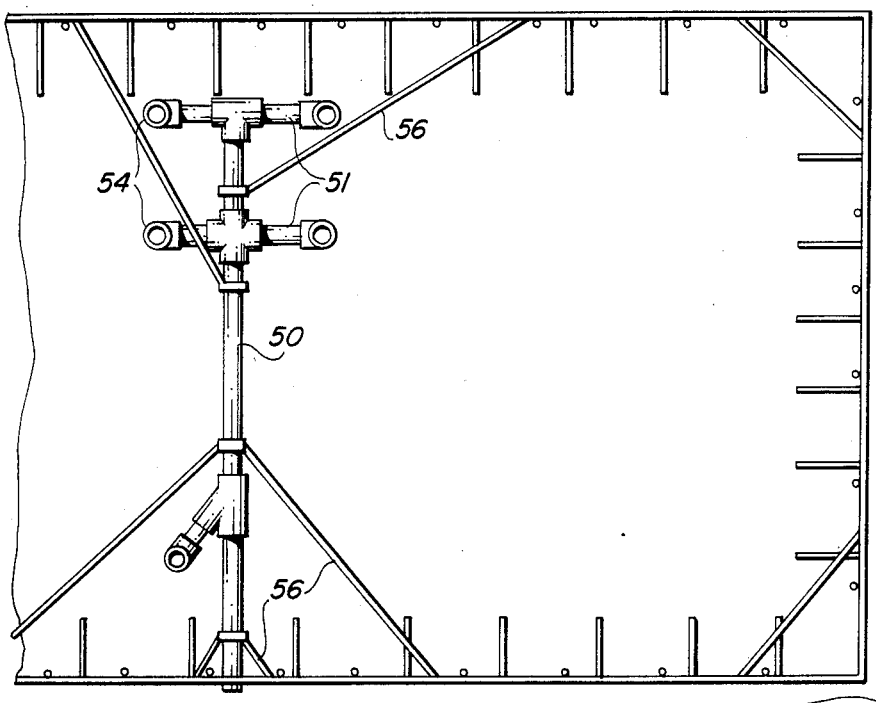
FIG. 4
FIG. 5
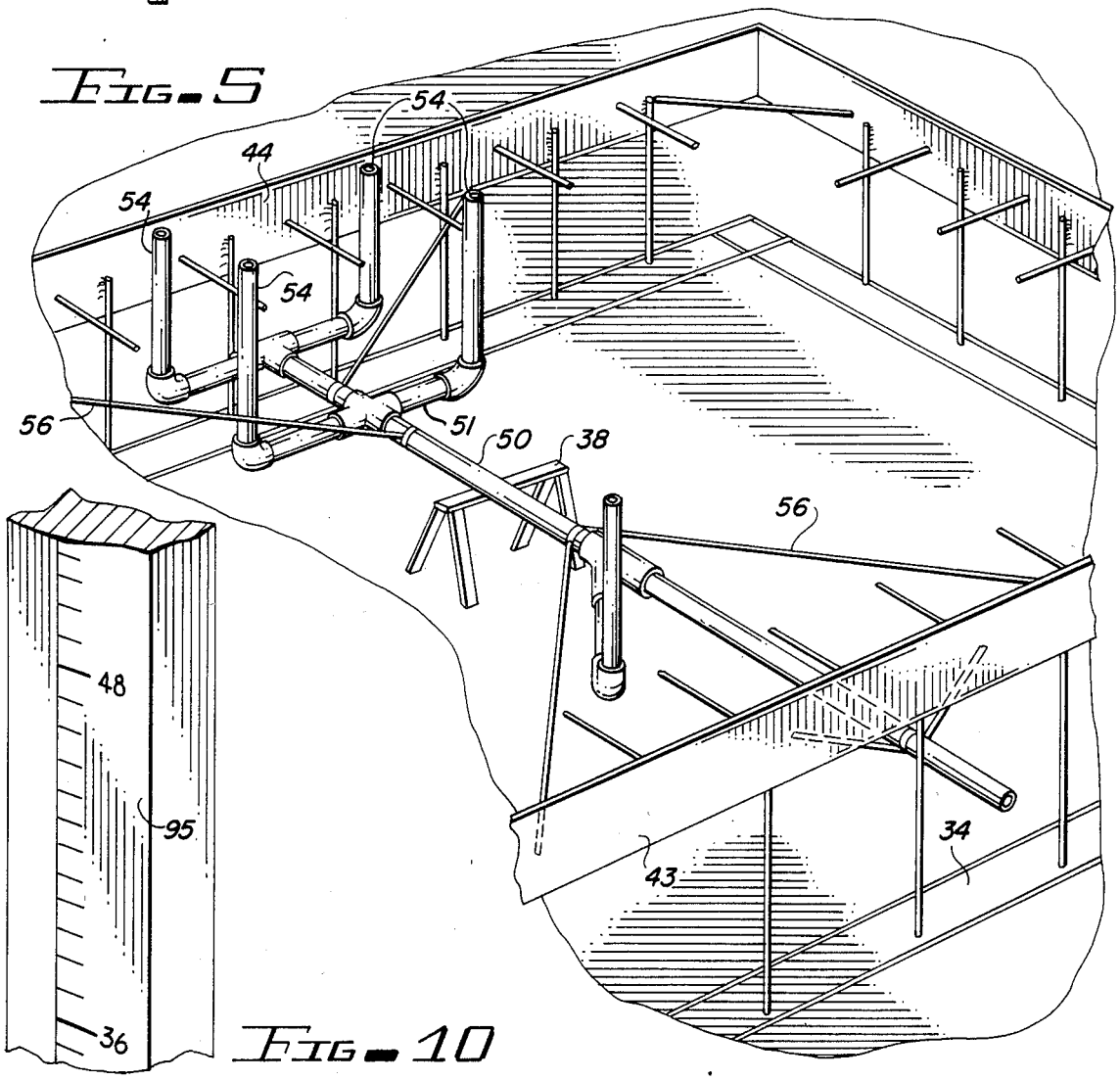
FIG. 10

FIG. 8
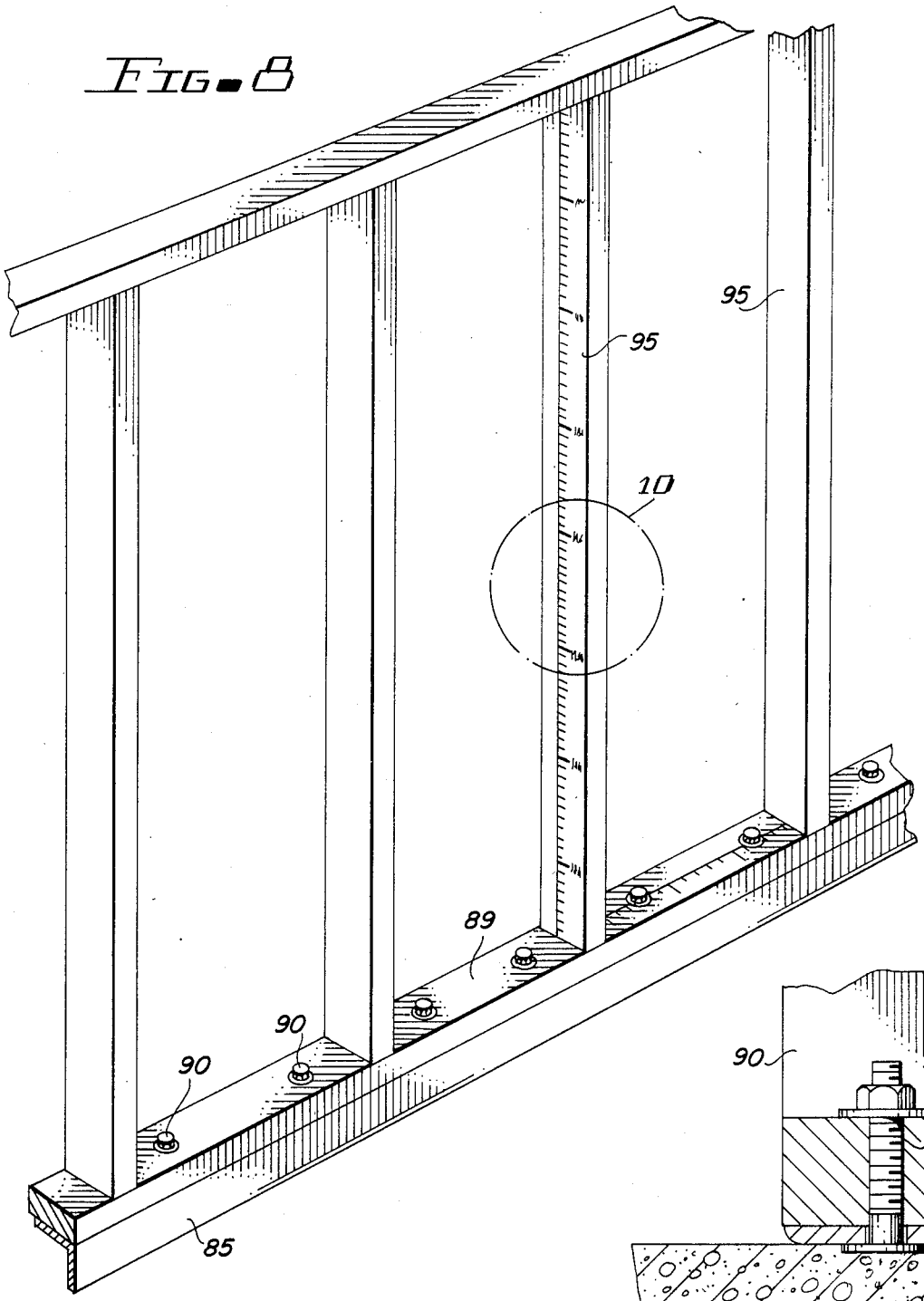
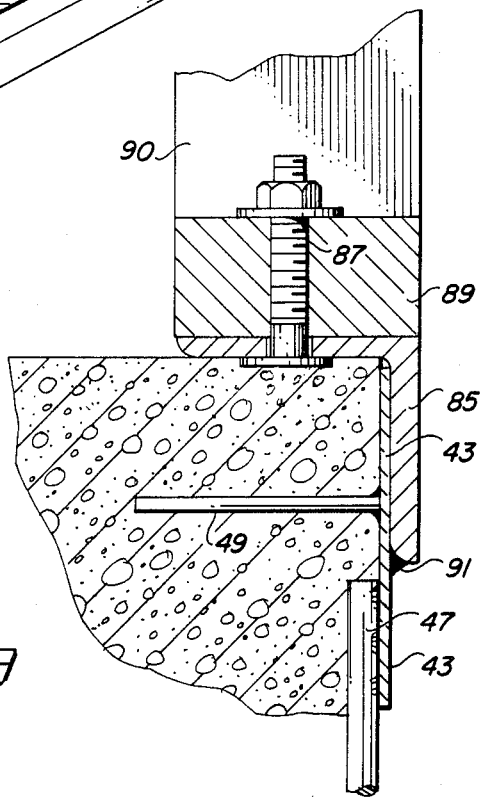
FIG. 9

METHOD OF CONSTRUCTING HOUSES

BACKGROUND

In recent years the building industry, and the housing industry portion in particular, frequently has been in a depressed state. While this is due to a variety of factors, a primary reason is the burgeoning costs of finished buildings and homes. A portion of these ever-increasing costs is the result of the high cost of labor which, added to increasing costs of different materials, results in final prices that frequently are prohibitive to a large number of prospective purchasers. Increasing numbers of such prospective purchasers are finding themselves priced out of the home market and their dream of owning their own home no longer is attainable.

In the building or assembly of buildings such as houses, many trades are involved, such as those who excavate and pour the foundation, masons and carpenters who construct the structure on the foundation, plumbers, electricians, roofers, and other specialties. In virtually every one of these trades, much of the labor cost is the result of time spent in taking measurements for the particular portion of the building or house assembly which is to be carried out by that trade. Frequently, the same or similar measurements are repeated by workers in different trades. Often, workers make the same measurement twice to minimize the possibilities of making mistakes. A consequence is that when all of this measuring time is added together, it amounts to a substantial part of the cost of the total labor cost in constructing the building or house.

If the measuring time could be eliminated or at least substantially reduced, the total labor cost of construction of buildings such as houses could be considerably reduced. This is particularly true in the case of developments where a large number of identical houses are constructed from a common plan within a relatively small geographical area. Large housing developments frequently have no more than 4 or 5 basic plans which are repeated throughout the development with a large number of houses for each plan being constructed within the development.

The use of common floor plans and other common features in housing developments has resulted in considerably reduced unit costs of houses which are constructed in such developments. A builder employs various workers in each of the trades, and houses in different stages of completion exist throughout the development with workers in one trade following directly behind workers in other trades in sequence as the houses are constructed. Because of the limited number of floor plans utilized, the workers relatively quickly become familiar with the particular design of the house on which they are working and much remeasurement time, which otherwise would exist, is eliminated. The necessity for making precise initial measurements at each stage of the construction for each house in the development, however, still exists.

Various attempts have been made in the past to provide factories which construct "pre-fabricated" houses. Construction of houses at points remote from their final erection site, however, is quite limited. A major limitation exists in the restrictions which are imposed on both width and height for moving pre-fabricated houses from a factory to the construction site. In addition, transportation costs are quite high; so that only relatively small pre-fabricated units have been found to be practical in the past. Most pre-fabricated homes are manufactured in the form of one or two sections of relatively narrow width and of limited design variations. Pre-fabricated or factory-built houses consequently do not constitute a very large percentage of the total housing market.

In an effort to provide more efficient and lower cost construction of houses in a housing development where a large number of identical or nearly identical houses are constructed, a temporary "factory" approach has been disclosed in two patents to Blachura, U.S. Pat. Nos. 4,110,952 and 4,187,659. Both of these patents are directed to a home building method in which a large tract of land is subdivided into lots. A factory is provided (subsequently to be converted into a school or shopping center in which the houses are built on jacks for subsequent towing to the individual lots where the houses are lifted by a crane onto the foundations prepared on the lots. Since all of the houses are built in a single factory location, some economies of scale are attained. The manner in which the houses are constructed in the factory, however, is not disclosed in these patents; so that it may be assumed that conventional construction techniques, with the necessity of multiple measurements, are employed.

Another patent which is directed to construction of a house in which pre-fabricated wall panels are brought to the construction site for incorporation into the finished house in the patent to Waring, U.S. Pat. No. 3,397,494. This patent utilizes a frame set over the foundation on adjustable legs to provide a screed for use in leveling a poured floor which is formed within the outline of the frame and which is poured simultaneously with the foundation. The adjustable legs are incorporated into the foundation to provide support and reinforcement for the finished building. Pre-fabricated wall panels then are clamped onto the frame in the construction of the house or building to be erected on the frame.

A system directed to the simplification and/or elimination of multiple measurements in laying out identical apartments or offices is disclosed in the patent to LaMar, U.S. Pat. No. 3,816,931. This patent utilizes an architectural template in the form of dimensionally stable, full-size fabric sheet which is removably securable to the floor of the apartment or office. The sheet includes marking guides in the form of grommeted openings at selected layout positions. Markers in the form of stamps are inserted through the openings and aligned by a keyway to print patterns on the substrate in exact positional and angular orientation with the reference lines to guide workmen in the construction of interior walls, doors, plumbing, electrical, cabinetry and the like. Consequently, pre-fabricated cabinetry and fixtures may be utilized with little or no on-site modification. This results in considerable cost savings.

While the foregoing patents each provide some improvement over conventional home construction, the major shortcomings inherent in home construction still are present. The necessity for measuring and remeasuring, with its consequent time consumption, is not overcome. Although the patent to LaMar eliminates some measurements, the disclosure of this patent is limited to office buildings and apartment buildings for location of interior features of the already-constructed building shell.

It is desirable to provide a home building system which eliminates or substantially reduces the time required to measure and establish the location of various construction items to thereby minimize the labor time in the building of structures such as houses. Such a system also should overcome the disadvantages of the prior art discussed above and be as error-free as possible, so that the total labor cost of construction of buildings such as houses may be considerably reduced.

SUMMARY OF THE INVENTION

Accordingly, it is an object of this invention to provide an improved building construction system.

It is another object of this invention to provide an improved building construction system using full-sized templates for minimizing the taking of measurements in the construction of buildings.

It is an additional object of this invention to provide improved modular construction of buildings.

It is a further object of this invention to provide a flexible template system and modular building construction for facilitating the construction of buildings which minimizes measuring errors and assists construction workers in accurately and quickly assembling various construction items onto the finished building.

It is yet another object of this invention to provide an improved mass fabrication method for building houses.

It is yet an additional object of this invention to provide a method of constructing houses which is particularly suitable for developing a large tract of land with individual houses.

BRIEF DESCRIPTION OF THE DRAWINGS

FIG. 1 illustrates a template used in laying out foundation and plumbing ditches in accordance with a portion of the building system of a preferred embodiment of the invention;

FIG. 2 illustrates a construction stage in accordance with the system of a preferred embodiment of the invention;

FIG. 3 illustrates a detail of a portion of the structure shown in FIG. 2;

FIG. 4 is a top view of an additional stage of the construction of the subassembly which is shown in FIGS. 2 and 3;

FIG. 5 is a perspective view of a portion of the structure shown in FIG. 4;

FIG. 8 illustrates a detail of a wall section constructed in accordance with the system of a preferred embodiment of the invention;

FIG. 9 is a detail of a construction stage of the interconnection of building portions at the lot location; and FIG. 10 is a detail of a portion of the structure shown in FIG. 8.

DETAILED DESCRIPTION

Figure 6:
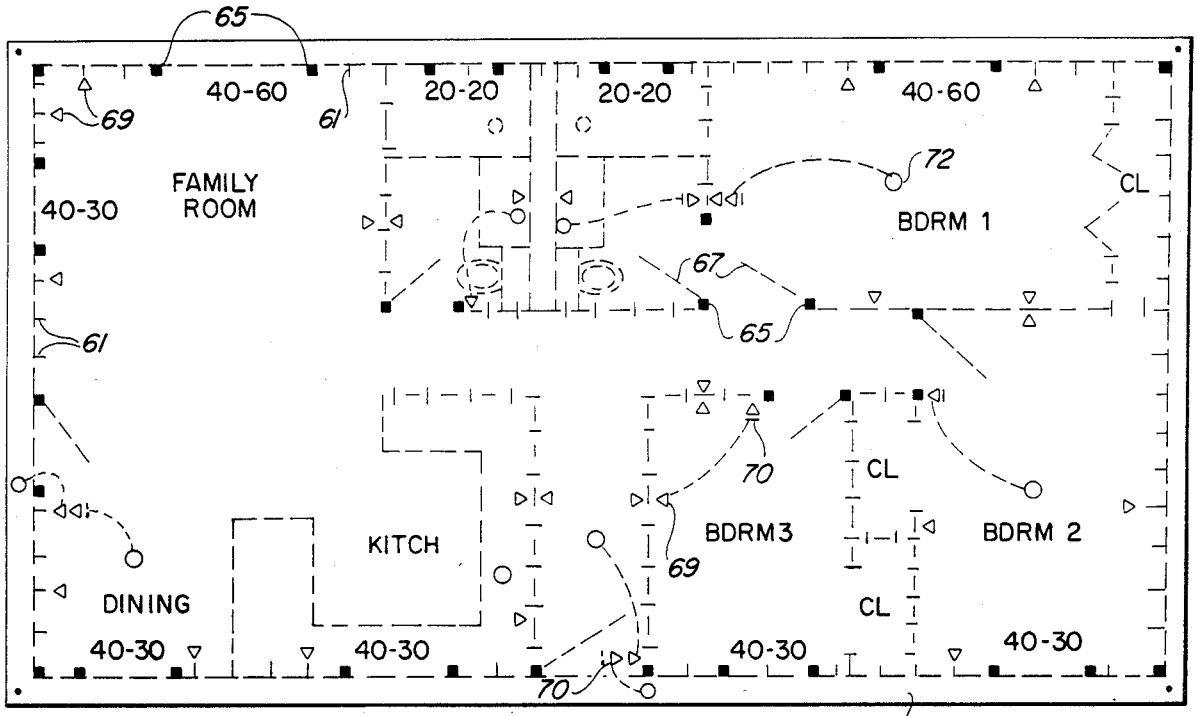
FIG. 6 is a top view of another template used in conjunction with the system of a preferred embodiment of the invention.

Reference now should be made to the drawings in which the same or similar reference numbers are used throughout the different figures to designate the same or similar components. The construction system which is capable of attaining maximum benefit from the advantages of the method or system described is of the general class of systems disclosed in the two patents to Blachura, U.S. Pat. No. 4,110,952 and U.S. Pat. No. 4,187,659. A factory location (subsequently to be converted to a school, shopping center or the like) first is established at the center of or near the edge of the development. Rough graded roads to the various lots for homesites are established, and all of the development grading is done in the manner currently employed for the preparation of a large tract development.

At each of the homesites, the first step is to locate the house on the homesite in any conventional manner for doing this. After that has been done, a full scale flexible tarpaulin template made of dimensionally stable material is placed to indicate where the foundation footings, plumbing trenches and the like are to be located. This tarpaulin 20 is pulled taut and staked over the area by driving stakes through grommets 21 at the corners and at other spaced locations, two of which are shown at the centers of the long sides in FIG. 1, as necessary. A material which has been found particularly suitable for the tarpaulin 20 shown in FIG. 1 is a nylon-reinforced tarpaulin which is commercially available for other purposes. This material does not stretch, so that various indicia holes through the tarpaulin for indicating various construction details are precisely located when the tarpaulin 20 is pulled taut and staked in place through the grommets 21.

On the tarpaulin 20 of FIG. 1 there are located a peripheral set of dotted or dashed line openings 24 for outlining the location of the outside foundation trench for the footings of the house to be constructed at the location where the tarpaulin is placed. There also are located a series of dotted line openings 25 to outline the locations where sewage trenches are to be dug in the ground underneath the tarpaulin 19. As illustrated in FIG. 1, the dotted lines 25 also include various branches or stubs which are on opposite sides of the main sewage trench for drains for tubs, toilets, sinks and the like. Marking of the foundation lines 24 and the sewage trenches 25 may be accomplished by the use of powdered chalk, spray paint or the like which is applied through the slits or openings 24 and 25 in the tarpaulin 20 to the ground beneath it. It is also possible, if desired, to provide such marking in the form of various stakes or nails driven through the openings 24 and 25 at spaced intervals, although the preferred method is to use powdered chalk or spray paint. Spray paint or chalk of different colors also may be used for the foundation lines 24 and the sewage trenches 25 to indicate to subsequent operators of equipment in the digging of the trenches the depth to which the various trenches are to be dug. If different colors are to be applied through the different slits 24 and 25, the color to be used may be clearly marked in large letters on the tarpaulin 20 at a spaced distance from the various slits; so that the instructions are not subsequently covered up by the material which is being applied through the slits to the ground beneath.

Once the ground has been marked by the tarpaulin 20 of FIG. 1, it is rolled up and removed from that particular building site. It then may be transported to a new building site and used again in the same manner to locate precisely the foundation and plumbing trenches needed for that building site. Consequently, measurements only need to be precisely made once on the full-size template tarpaulin 20 itself. After the ground has been marked up, the foundation and sewage trenches are dug in a conventional manner to prepare the building site for the next step in construction.

Following steps in the building system or method of this invention take place in the factory building (not shown, but comparable to the one of the Blachura's Patents). Here a tarpaulin 20, which is either the same one used as described above in preparing the foundation and sewage trenching on the lot location or one which is identical to it, may be laid out on the floor of the factory building. This floor is utilized as a construction surface for the building of modules of the houses which are to be subsequently erected on the various lots of the tract. Markings are made on the floor or construction surface of the factory through the tarpaulin 20, much in the same manner as described above in conjunction with the preparation of the actual building site. These markings then are relatively permanently enhanced on the floor by painting strips or taping the floor to the actual dimensions of the foundation and sewage trenches which will be present at the building site after the trenching equipment has formed these trenches. These indicia on the construction surface or floor of the factory site are indicated by the strips 34 for the foundation and 35 for the sewage and plumbing trenches. Alternatively, the markings for the strips 34 and 35 may be made following direct measurements on the construction surface without using the tarpaulin 20.

Temporary building stands 37 (illustrated for purposes of this description as saw horses) then are placed at spaced locations over the marked lines 34 corresponding to the foundation trenches. Similarly, temporary stands, such as the stand 38, are located over the marked lines 35 for the sewage and plumbing ditches on the construction surface. The height of the stands 37 and 38 is selected to permit construction of a subframe on these stands which includes a peripheral metal form comprised of end plates 40 and 41 and side plates 43 and 44, illustrated in FIGS. 2, 3, 4 and 5. These plates or strips 40, 41, 43 and 44 preferably are made of metal approximately ¼" thick and 8" high. Steel plates are preferred. The plates are assembled in an open rectangular box or frame by welding them together at the corners; and appropriate corner braces, such as the braces 45, may be used to stabilize the frame. This open frame then has vertical reinforcing bars 47 attached on the inside of the frame approximately every 4 feet and extending downwardly to a point which falls just short of the bottom of the foundation trench, when the subassembly shown in FIGS. 2, 3, 4 and 5 is subsequently moved to the actual building site location. Similarly, horizontal reinforcing bars 49 are attached at spaced intervals (approximately every 6 or 8 feet) to extend approximately 8 or 10 inches in length toward the inside of the area defined by the frame formed by the members 40, 41, 43 and 44. This is a basic sub-assembly which is used to provide reinforced concrete in the foundations of the house and to tie an external sub-frame formed by the members 40, 41, 43 and 44 to the foundation and to the poured concrete floor of the house to be constructed.

The underground plumbing for the house to be constructed also is pre-assembled and attached to the frame members 40, 41, 43 and 44 while the frame is in position at the factory site on the construction surface. The plumbing is located by the markings 35 on the construction surface and includes the main sewer line 50 and the various branch connections 51 for the different drains which are connected to the sewer line 50. Similarly, if the water lines for the building are to be placed underground, they also are pre-fabricated at the factory in the same manner as the sewage lines illustrated in FIGS. 4 and 5.

The sewage lines and the branches 51 are provided with jigs and supports such as the support 38 spaced at strategic locations over the markings 35 on the construction surface. The supports 38 are varied in height in accordance with the height at which the various plumbing lines are to be located beneath the lower surfaces of the plates 40, 41, 43 and 44 and may be spaced to provide the appropriate slope or angle to effect proper drainage. The pipes 50 and 51 may also be held in place temporarily by suitable jigs (not shown), and stubouts 54 are provided of sufficient height to extend above the floor line of the slab of the house which is to be constructed at the building site. The plumbing lines are held in place by means of cables 56 which are welded or otherwise suitably attached to the strips 43, 44 (and, if necessary, 40 and 41) and to various points on the lines 50 and 51 to provide both vertical, side-to-side, and front-to-back location of the underground plumbing for the house in the subassembly of FIGS. 2, 3, 4 and 5.

After the sub-assembly of FIGS. 2, 3, 4 and 5 has been completed at the factory site as described above, it is moved, preferably by a mobile crane, from the factory site over the roads in the tract to the location of the house which is to be constructed. As stated previously, the foundation and plumbing trenches already have been dug. The sub-assembly of FIGS. 2, 3, 4 and 5 then is lowered into place over the foundation trench. Since this sub-assembly has been made in accordance with the same template 20 that was used to guide the workers in the digging of the foundation and plumbing trenches or ditches, the assembly fits precisely over these locations. The vertical reinforcing bars 47 drop into the foundation trenches, and the underground plumbing 50 and 51 also goes into the plumbing trenches 25. The frame 40, 41, 43 and 44 is leveled, gravel is placed in the plumbing trenches and at the bottom of the footings, and grading of the property is effected. Temporary supports (not shown) may be used to hold the frame 40, 41, 43 and 44 in proper location over the foundation trenches. Since all of the rough plumbing, foundation trenches, and reinforcement is in place, it is possible for the building inspection for the footing and rough plumbing to be combined into a single inspection at this time. After the inspection, the footings and floor for the house can be poured at the same time. The upper edges of the frame strips 40, 41, 43 and 44 may be used as a screed for the floor. It is readily apparent that the reinforcing bars 47 and 49 lock the frame 40, 41, 43 and 44, and the associated plumbing attached to it, firmly in place into the concrete forming the foundation and the floor.

In the factory area, in a different location from the one described previously, a second full-scale template in the form of a flexible tarpaulin 60 (FIG. 6) is placed on the construction surface. Tarpaulin 60 is drawn tight and temporarily attached, in any suitable manner, to the construction surface. The tarpaulin 60 is a full scale representation of the construction details necessary for erecting the above-floor portion of the house or building.

The tarpaulin 60 has openings of various types and sizes formed through it which are representative of various construction details. These details include stud locations, window and door opening locations, electrical outlet and switch locations, plumbing locations and the like. For example, the carpentry walls, both exterior and interior, are marked with the stud locations 61 in the exact locations for subsequent construction of these walls. Similarily, locations 65 (illustrated in the form of square apertures) are indicated for each of the door and window openings. For the doors, dotted line slits 67 are provided adjoining appropriate ones of the apertures 65 to indicate the hinged side of the door and to distinguish door openings from window openings.

Electrical outlets are designated by the triangular symbols 69 and wall switches by the combined triangular and dashed symbols 70, with dotted lines interconnecting the switches 70 with appropriate outlets 69 or circular symbols 72 for ceiling or wall-mounted light fixtures. Indicia can be placed adjacent each of these different symbols to direct workmen as to which color of paint or chalk is to be applied through the apertures to mark the construction surface location beneath the tarpaulin 60. In addition, between each of the pairs of square apertures 65 designating the location of a window, numbers are provided, the first of which is the height above the floor for the window and the second of which is the width of the window to be placed between each of the respective pairs of window aperture indicia 65. These numbers may be in the form of stencil-like openings so that spraying paint over the numbers causes a transfer to the construction surface beneath the tarpaulin. The various indicia may be color coded, either by words or actual color, to assist workmen in applying the correct colors through the different apertures to mark the construction surface beneath the tarpaulin 60 accordingly. While color coding in this manner is recommended, it is not necessary, and all of the indicia could be transferred through the tarpaulin 60 to the construction surface beneath it by the use of a single color, if desired.

Figure 7:
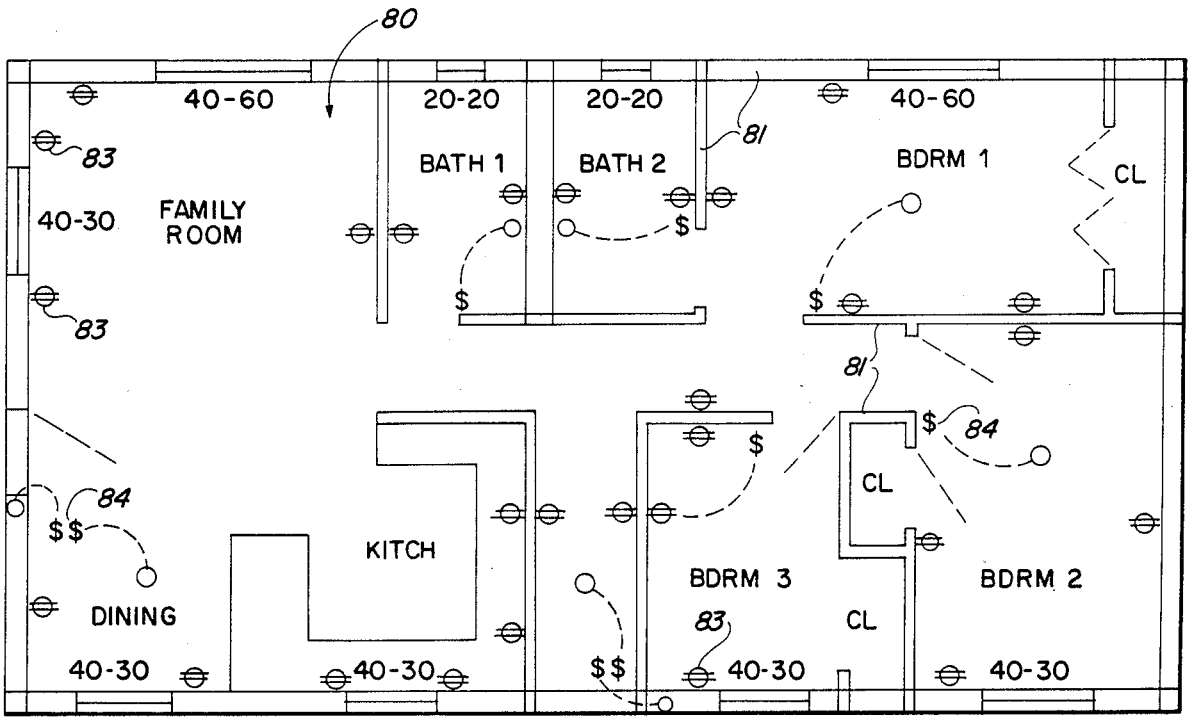
FIG. 7 illustrates markings provided by use of the template of FIG. 6.

Once the indicia have been transferred through the tarpaulin 60, it is removed and rolled up for subsequent use at another location. The floor or construction surface marked by the various indicia then is taped or painted in accordance with the information provided through the tarpaulin 60 as indicated in FIG. 7. Comparison of the floor plan 80 of the housing in FIG. 7 with the marked-up tarpaulin 60 of FIG. 6 readily provides visual correlation between the indicia on the tarpaulin 60 and the marked or taped representation of the floor plan 80 on the construction surface. If the floor plan is to be used at only a single construction site, it may be desirable to measure and mark the indicia on the construction surface without using the tarpaulin 60.

The interior and exterior walls of the house are represented by 4" wide tape strips 81 and a wider tape strip 82 (for a thicker plumbing wall between the two baths). Similarily, the wall plug indicia 83 are marked in accordance with the locations of the apertures 69 in the tarpaulin 60. Switches 84 are marked in accordance with the locations of the switch indicia 70 on the tarpaulin 60, and so on for all of the different symbols and designations which are present on the tarpaulin 60. These designations include anything that also hangs on studs or is placed on joists. Designations for such items such as electric boxes, plumbing stubouts, vent registers, etc. are indicated on the floor plan 80 next to or below their respective locations. In addition, along with the various indicia are specific instructions, such as "blue circuit, 4 feet high". These instructions direct the electrician that the box at that location is hung 4 feet off the floor and that it is wired into the blue circuit which is a specific circuit of the house being constructed. Various other designations are provided. Such word or textual instructions have not been shown in FIGS. 6 and 7 in order to avoid cluttering the drawing. It is apparent, however, that texts of this type may be incorporated in a stencil-like fashion on the tarpaulin 60 along with the other indicia which has been described above.

For the actual construction of the walls of the building, reference now should be made to FIGS. 8, 9 and 10. FIG. 8 is a representation of a portion of an external wall, showing the manner of construction of this wall. An open rectangular frame made of front, back and two end members, comparable to the frame members 40, 41, 43 and 44 of the foundation framework, is constructed. A portion of this frame is shown in FIG. 8 and comprises a member 85. This member has an L-shaped cross-section (as shown most clearly in FIG. 9) and is located around the outer edge of the taped representation of the floor plan 80 on the construction surface. The corners of the members 85 are joined together by welding or other suitable means. The house then is ready to be constructed on this frame. Carriage bolts 87 extend upwardly through the upper or horizontal surface of the L-shaped member 85 for attachment of the plate 89 for the exterior walls. The plate 89 is attached by means of nuts 90 in a conventional fashion to securely fasten the plate 89 to the frame 85 on all four sides of the house.

To facilitate the construction of the building, all of the studs which are used are pre-cut to the desired length, and all of the studs also are pre-marked in increments of inches to indicate the various heights above the finished floor. These increment markings are shown on one of the studs 95 of FIG. 8 and are shown in greater detail in the enlarged partial representation of the stud 95 in FIG. 10. All of the vertical studs are marked to commence at the proper number of inches above the floor (taking into account the thickness of the plate 89) so that if an indicia on the construction surface of FIG. 7 directs an electrician to mount an electrical box four feet from the floor, the electrician simply has to find the forty-eight inch marker on the appropriate stud 95 and mount the box accordingly. No measurements are necessary. Consequently, construction is greatly facilitated. All of the rough electrical, rough plumbing and rough mechanical structure for the house as well as the exterior and interior walls are completed at this time. In addition, in most cases, the roof system and the rough mechanical work also should be completed; so that the housing is ready to be set in place.

The house can be moved either by a mobile crane or by a standard moving trailer, such as the type disclosed in the Blachura Patents, to the building lot and then lifted by crane and placed over the foundation frame 40, 41, 43 and 44, described previously. The dimensions of the house built on the base frame 85 are such that the vertical legs of the frame members 85 on all four sides extend downwardly over the outside surfaces of the members 40, 41, 43 and 44. This is illustrated in the partially-cutaway view of FIG. 9. Once the house is in place over the foundation framework, the two metal frames are welded together along the lower edge of the frame 85, as indicated by the welding bead strip 90 in FIG. 9. This causes the house to be securely attached to the foundation framework. The foundation framework, in turn, is securely held to the foundation and floor by means of the reinforcement bars 47 and 49. The house is now ready for the plumbing, framing, electrical and mechanical rough-in inspection.

After the rough-in inspection, construction of the house is fairly much the same as presently utilized for large scale housing developments. Ideally, however, the floor covering should be pre-cut and cabinets pre-made. Since all of the walls have been constructed in accordance with the single floor plan shown in FIG. 7, pre-made cabinets should fit in all of the houses made in accordance with that same floor plan. Final finishing of the interior and exterior walls then is completed on the building site or lot site itself.

Since shopping centers and other support facilities usually are developed after a residential neighborhood is constructed, the factory site then can be completed to finish the shopping center or school when it no longer is needed for the construction of houses. This process requires that the shells or at least the floors and roofs of shopping centers are developed and used as temporary manufacturing plants for the houses in a particular development. A minor re-design of some of these shopping center or school facilities may be necessary after their use as a house building factory no longer is necessary. That re-design may be completed to finish the housing development along with the necessary supporting schools and shopping regions. The various roads throughout the area may be completed and finished after the heavy construction cranes and house moving equipment no longer needs to pass over them. Consequently, as mentioned in the Blachura Patents, the houses farthest from the factory location typically should be completed first, with those nearest the factory location being the last to be constructed.

It also is apparent that more than a single floor plan may be used in any given development. The utilization of a limited number of floor plans (usually 6 or less) typically employed in housing developments still may be continued. All that is necessary is to provide different tarpaulin template sets 20 and 60 for each of the different houses to be constructed. Construction may be effected by making all of the houses of a single floor plan first, then building houses according to a second floor plan. Alternatively, different areas of a construction surface may be utilized for each different type of house floor plan to be constructed.

Various changes and modifications will occur to those skilled in the art without departing from the true scope of this invention. Obviously, the floor plans which have been illustrated in the various figures of the drawings may be modified in a wide number of different ways to incorporate different floor plans for different houses of different sizes. The particular indicia which have been shown on the templates used in this construction method also may be varied without departing from the scope of the invention. Variations may be made in the foundation framework and in the above-floor framework which has been described without departing from the invention. The embodiment which has been disclosed is to be considered illustrative of the invention only and not as limiting.

I claim:

1. A method of constructing houses including in combination the steps of:

providing a construction surface having a size greater than the exterior dimensions of a house to be constructed;

using a first full-scale template in the form of a flexible, dimensionally-stable sheet to mark footing and plumbing trenching lines on the lot where a house is to be erected;

excavating foundation footings and plumbing trenches in the locations marked by use of said first template;

constructing a first metal frame having external dimensions of the house to be constructed;

temporarily supporting said first metal frame above said construction surface and attaching assembled below-floor plumbing components for said house to said first frame;

moving said first frame with the attached plumbing components to said lot;

placing said first frame and attached plumbing components in position over said footing and plumbing trenches;

pouring footings for said house with said first frame in place;

marking indicia on said construction surface, showing the location of various construction items for said house, said indicia being encoded to represent and distinguish different ones of said various construction items from one another;

constructing at least a portion of said house, including the exterior walls, on a second metal frame on said building surface and including other structural components in accordance with said indicia marked on said construction surface, said second metal frame being dimensioned at least in part to fit onto said first metal frame;

moving the portion of said house on said second metal frame to said lot;

placing said second metal frame on said first metal frame; and attaching said first and second metal frames together.

2. The method according to claim 1 wherein said first metal frame is temporarily supported on said construction surface a predetermined distance above said surface and further including the step of attaching reinforcing members extending downwardly therefrom to be located within the footing trench when said first metal frame is placed in position over said footing and plumbing trenches.

3. The method according to claim 2 further including the step of marking said foundation and plumbing lines on said construction surface prior to the step of attaching said plumbing components to said first metal frame.

4. The method according to claim 3 wherein said first metal frame is constructed in the form of an open box, the sides of which are elongated flat strips oriented in vertical planes, said box having an open top and bottom; said second metal frame comprises members with an L-shaped cross-section, having an upper horizontal leg and a downwardly depending leg and with the opening of the "L" facing toward the surface enclosed by said second metal frame; and wherein placement of said second metal frame over said first metal frame so that the upper edges of the sides of said first metal frame rest against the undersides of the upper horizontal legs of said second metal frame, and the depending legs of said L-shaped second metal frame overlie the outside of said first metal frame.

5. The method according to claim 4 further wherein the step of attaching said second metal frame to said first metal frame is by welding.

6. The method according to claim 5 wherein the step of constructing at least a portion of said house includes construction of the exterior walls, at least the major portion of the interior walls, and the entire roof of said house on said building surface, with the exterior walls thereof attached to the upper surface of the horizontal legs of said second metal frame.

7. The combination according to claim 6 wherein said walls of said house are comprised of stud construction; and further including the step of premarking distance measurements on each of said studs prior to the assembly thereof into the walls of said house for facilitating the location of other structural components in the building of said house.

8. The method according to claim 7 further including the step of attaching horizontal reinforcing bar components to the inside surface of said first metal frame prior to transporting said first metal frame to said lot.

9. The method according to claim 8 wherein a second full-scale template is used to mark said encoded indicia and said first template, or a template identical to said first template, is used to mark said foundation and plumbing lines on said construction surface; and said indicia on said first and second full-scale templates are in the form of openings therethrough.

10. The method according to claim 9 wherein said indicia openings are in different shapes to represent different construction details.

11. The method according to claim 10 wherein said indicia on said first and second full-scale templates include color markings adjacent thereto, representative of different construction details.

12. The method according to claim 10 wherein said first and second flexible templates comprise tarpaulins to be drawn tight over the area where construction features are to be located.

13. The method according to claim 12 wherein said second full-scale template is removed from said building surface after the marking thereof using said second template and the markings on said building surface are enhanced thereon prior to construction of said at least a portion of said house on said second metal frame, the markings on said building surface being used to guide workers in the construction of said at least a portion of said house on said second metal frame.

14. The method according to claim 1 further including the step of using said first template, or a template which is substantially identical to said first template, to mark said foundation and plumbing lines on said construction surface prior to the step of attaching said plumbing components to said first metal frame.

15. The method according to claim 1 wherein said first metal frame is constructed in the form of an open box, the sides of which are elongated flat strips oriented in vertical planes, said box having an open top and bottom; said second metal frame comprises members with an L-shaped cross-section, having an upper horizontal leg and a downwardly depending leg and with the opening of the L facing toward the surface enclosed by said second metal frame; and wherein placement of said second metal frame over said first metal frame so that the upper edges of the sides of said first metal frame rest against the undersides of the upper horizontal legs of said second metal frame, and the depending legs of said L-shaped second metal frame overlie the outside of said first metal frame.

16. The method according to claim 15 further wherein the step of attaching said second metal frame to said first metal frame is by welding.

17. The method according to claim 1 wherein the step of constructing at least a portion of said house includes construction of the exterior walls, at least the major portion of the interior, walls and the entire roof of said house on said building surface, with the exterior walls thereof attached to the upper surface of the horizontal legs of said second metal frame.

18. The combination according to claim 1 wherein said walls of said house are comprised of stud construction; and further including the step of premarking distance measurements on each of said studs prior to the assembly thereof into the walls of said house for facilitating the location of other structural components in the building of said house.

19. The method according to claim 1 further wherein the step of attaching said second metal frame to said first metal frame is by welding.

20. The method according to claim 1 further including the step of attaching horizontal reinforcing bar components to the inside surface of said first metal frame prior to transporting said first metal frame to said lot.

21. The method according to claim 1 wherein said indicia on said first template are in the form of openings therethrough.

22. The method according to claim 21 wherein said indicia openings are in different shapes to represent different construction details.

23. The method according to claim 22 wherein said first flexible template comprises a tarpaulin to be drawn tight over the area where construction features are to be located.

24. The method according to claim 23 wherein said indicia on said first full-scale template include color markings adjacent thereto, representative of different construction details.

* * * * *